US008499566B2

(12) United States Patent
Lacy et al.

(10) Patent No.: US 8,499,566 B2
(45) Date of Patent: Aug. 6, 2013

(54) COMBUSTOR LINER COOLING SYSTEM

(75) Inventors: Benjamin Paul Lacy, Greer, SC (US); Mert Enis Berkman, Greenville, SC (US)

(73) Assignee: General Electric Company, Schenectady, NY (US)

( * ) Notice: Subject to any disclaimer, the term of this patent is extended or adjusted under 35 U.S.C. 154(b) by 499 days.

(21) Appl. No.: 12/855,156

(22) Filed: Aug. 12, 2010

(65) Prior Publication Data

US 2012/0036858 A1 Feb. 16, 2012

(51) Int. Cl.
*F02C 7/12* (2006.01)

(52) U.S. Cl.
USPC ..... 60/754; 60/752

(58) Field of Classification Search
USPC ..... 60/752–760
See application file for complete search history.

(56) References Cited

U.S. PATENT DOCUMENTS 4,118,146 A 10/1978 Dierberger
4,296,606 A * 10/1981 Reider ..... 60/754
4,311,433 A 1/1982 Bratton et al.
5,626,462 A 5/1997 Jackson et al.
5,640,767 A 6/1997 Jackson et al.
6,375,425 B1 * 4/2002 Lee et al. ..... 416/97 R
6,461,107 B1 10/2002 Lee et al.
6,461,108 B1 10/2002 Lee et al.
6,499,949 B2 12/2002 Schafrik et al.
6,528,118 B2 3/2003 Lee et al.
6,551,061 B2 4/2003 Darolia et al.
6,582,194 B1 6/2003 Birkner et al.
6,617,003 B1 9/2003 Lee et al.
6,905,302 B2 6/2005 Lee et al.
7,010,921 B2 * 3/2006 Intile et al. ..... 60/752
7,041,154 B2 5/2006 Staroselsky et al.
7,465,335 B2 12/2008 Schmidt
7,487,641 B2 2/2009 Frechette et al.
2002/0106457 A1 8/2002 Lee et al.
2002/0141869 A1 10/2002 Lee et al.
2003/0010035 A1 * 1/2003 Farmer et al. ..... 60/752
2003/0115881 A1 * 6/2003 Lee et al. ..... 60/754
2005/0044857 A1 * 3/2005 Glezer et al. ..... 60/772
2009/0120093 A1 * 5/2009 Johnson et al. ..... 60/752
2010/0077761 A1 * 4/2010 Johnson et al. ..... 60/752

OTHER PUBLICATIONS

U.S. Appl. No. 12/765,372, filed Apr. 22, 2010.

* cited by examiner

*Primary Examiner* — Gerald Luther Sung
*Assistant Examiner* — Scott Walthour
(74) *Attorney, Agent, or Firm* — Dority & Manning, P.A.

(57) ABSTRACT

A combustor liner is disclosed. The combustor liner includes an upstream portion, a downstream end portion extending from the upstream portion along a generally longitudinal axis, and a cover layer associated with an inner surface of the downstream end portion. The downstream end portion includes the inner surface and an outer surface, the inner surface defining a plurality of microchannels. The downstream end portion further defines a plurality of passages extending between the inner surface and the outer surface. The plurality of microchannels are fluidly connected to the plurality of passages, and are configured to flow a cooling medium therethrough, cooling the combustor liner.

20 Claims, 7 Drawing Sheets

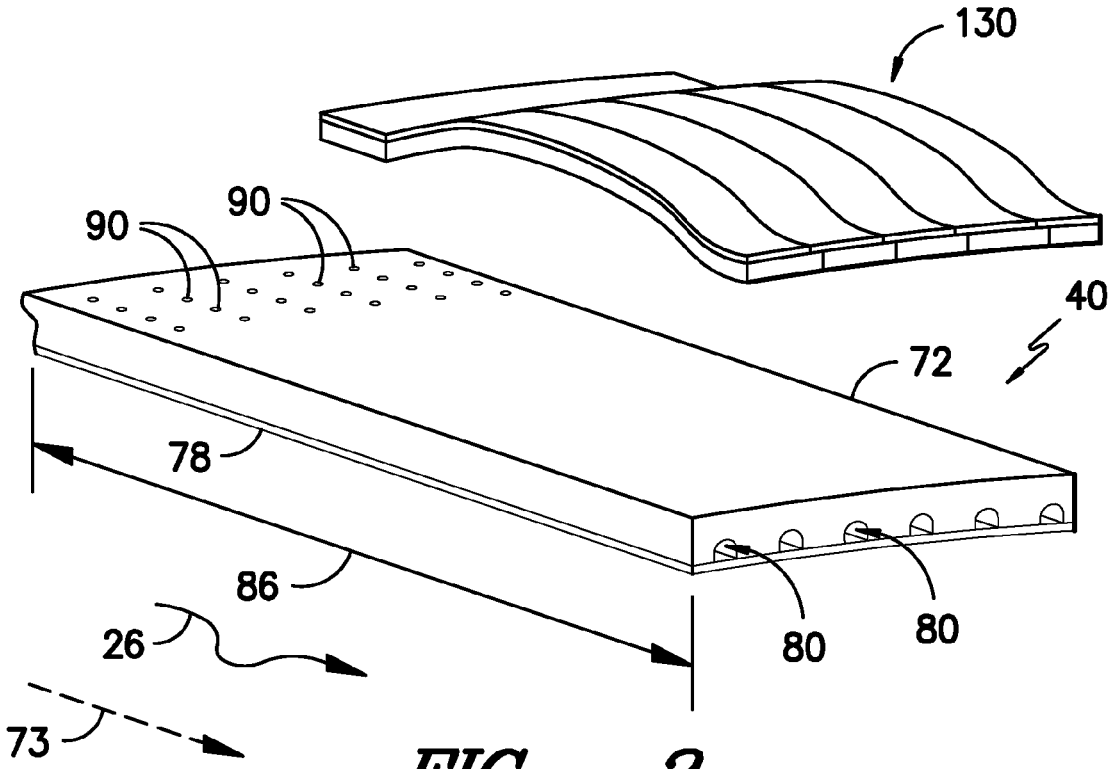
FIG. –3–
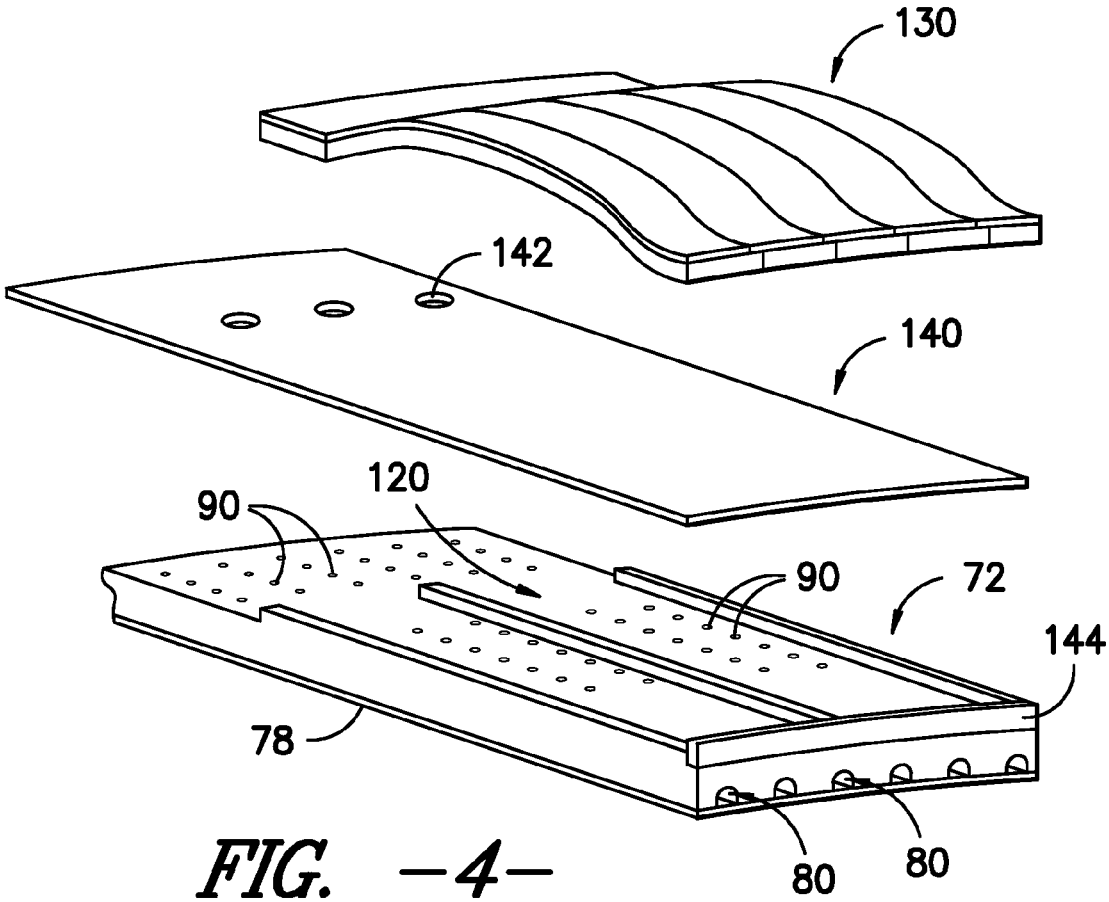
FIG. –4–

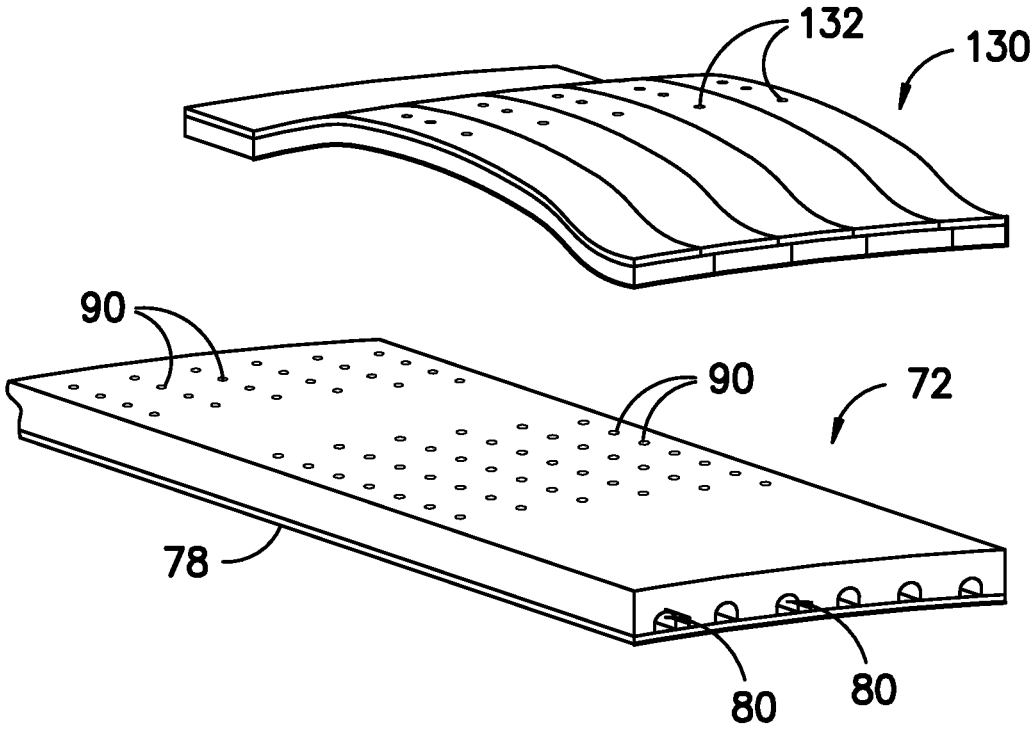
FIG. –5–

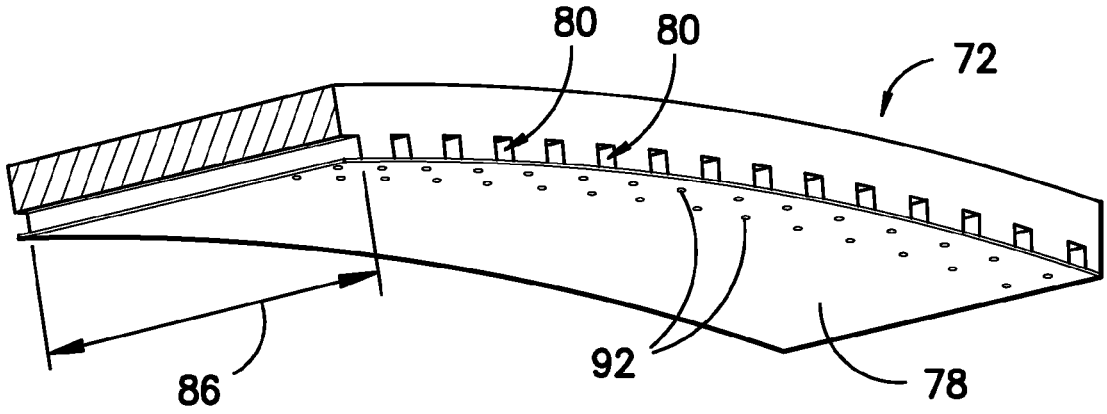
FIG. –6–
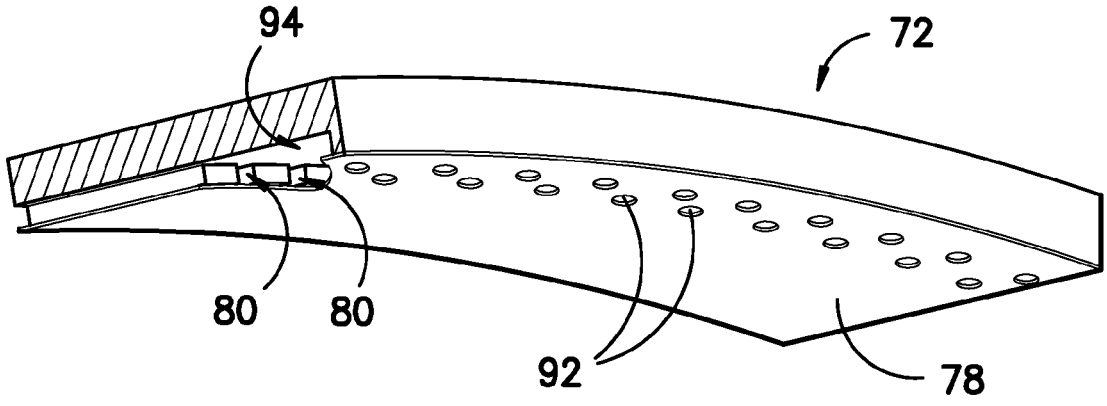
FIG. –7–

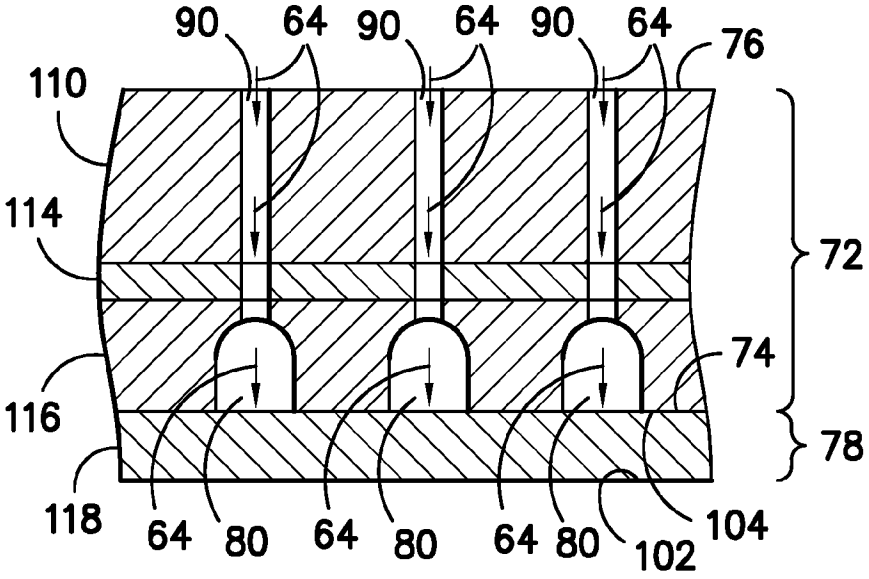
FIG. —10—
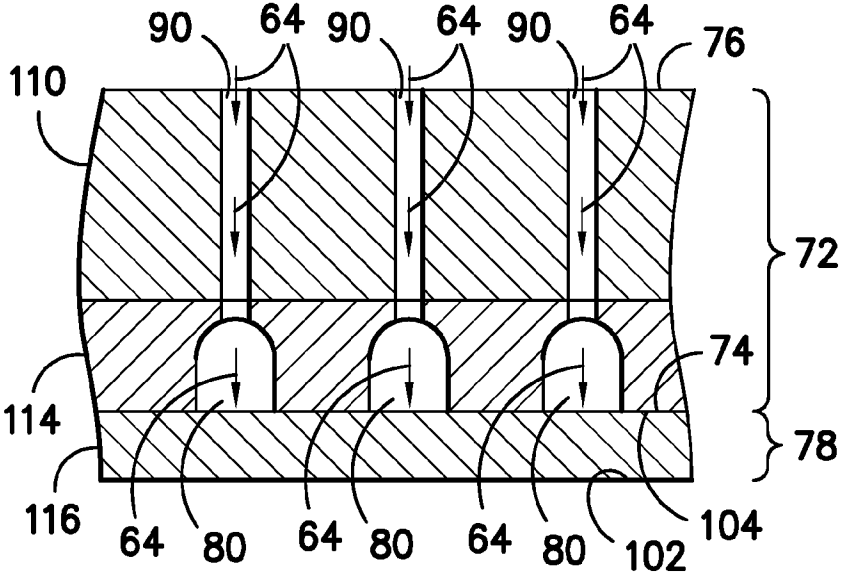
FIG. —9—

COMBUSTOR LINER COOLING SYSTEM

FEDERAL RESEARCH STATEMENT

This invention was made with Government support under contract number DE-FC26-05NT42643 awarded by the Department of Energy. The Government may have certain rights in the invention.

FIELD OF THE INVENTION

The subject matter disclosed herein relates generally to gas turbine systems, and more particularly to apparatus for cooling a combustor liner in a combustor of a gas turbine system.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

One gas turbine system component that should be cooled is the combustor liner. As high temperature flows caused by combustion of an air-fuel mix within the combustor are directed through the combustor, the high temperature flows heat the combustor liner, which could cause the combustor liner to fail. Specifically, the downstream end portion of the combustor liner may be connected to other components of the combustor, such as a transition piece, via a seal, and may thus not be exposed to various air flows that may cool the remainder of the combustor liner. Thus, the downstream end portion may be a life-limiting section of the combustor liner which may fail due to exposure to high temperature flows. Thus, in order to increase the life of the combustor liner, the downstream end portion must be cooled.

Various strategies are known in the art for cooling the downstream end portion of the combustor liner. For example, a portion of the air flow provided from the compressor through fuel nozzles into the combustor may be siphoned through an annular wrapper to channels defined in the outer surface of the downstream end portion of the combustor liner. As the air flow is directed through these channels, the air flow may cool the downstream end portion. However, cooling of the downstream end portion by the air flow within these channels is generally limited by the thickness of the downstream end portion, which reduces the proximity of the channels to the high temperature flows inside the combustor liner, thus reducing the cooling effectiveness of the channels. Further, cooling of the combustor liner through channels defined in the outer surface of the downstream end portion of the combustor liner generally results in comparatively low heat transfer rates and non-uniform combustor liner temperature profiles.

Thus, an improved cooling system for a combustor liner would be desired in the art. For example, a cooling system that provides relatively high heat transfer rates and relatively uniform temperature profiles in the downstream end portion of the combustor liner would be advantageous. Additionally, a cooling system for a combustor liner that reduces the amount of cooling flow required for cooling the combustor liner would be desired.

BRIEF DESCRIPTION OF THE INVENTION

Aspects and advantages of the invention will be set forth in part in the following description, or may be obvious from the description, or may be learned through practice of the invention.

In one embodiment, a combustor liner is disclosed. The combustor liner includes an upstream portion, a downstream end portion extending from the upstream portion along a generally longitudinal axis, and a cover layer associated with an inner surface of the downstream end portion. The downstream end portion includes the inner surface and an outer surface, the inner surface defining a plurality of microchannels. The downstream end portion further defines a plurality of passages extending between the inner surface and the outer surface. The plurality of microchannels are fluidly connected to the plurality of passages, and are configured to flow a cooling medium therethrough, cooling the combustor liner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a perspective view of one embodiment of the downstream end portion of the combustor liner of the present disclosure;

FIG. 4 is an exploded perspective view of another embodiment of the downstream end portion of the combustor liner of the present disclosure;

FIG. 5 is an exploded perspective view of another embodiment of the downstream end portion of the combustor liner of the present disclosure;

FIG. 6 is a perspective view of another embodiment of the downstream end portion of the combustor liner of the present disclosure;

FIG. 7 is a perspective view of another embodiment of the downstream end portion of the combustor liner of the present disclosure;

FIG. 9 is a cross-sectional view of another embodiment of the downstream end portion of the combustor liner of the present disclosure; and FIG. 10 is a cross-sectional view of another embodiment of the downstream end portion of the combustor liner of the present disclosure.

DETAILED DESCRIPTION OF THE INVENTION

Figure 1:
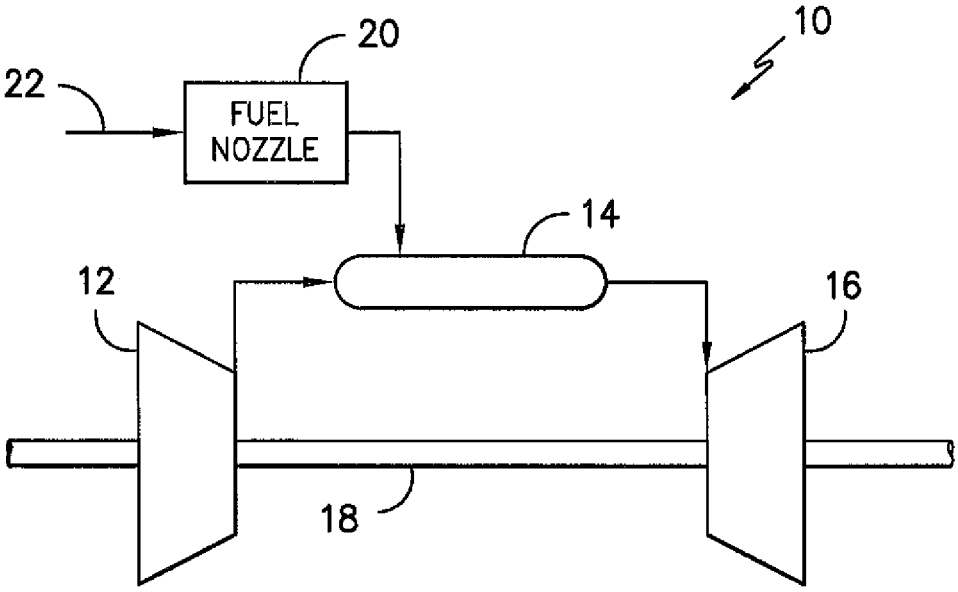
FIG. 1 is a schematic illustration of a gas turbine system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, a turbine 16, and a fuel nozzle 20. Further, the system 10 may include a plurality of compressors 12, combustors 14, turbines 16, and fuel nozzles 20. The compressor 12 and turbine 16 may be coupled by a shaft 18. The shaft 18 may be a single shaft or a plurality of shaft segments coupled together to form shaft 18.

The gas turbine system 10 may use liquid or gas fuel, such as natural gas or a hydrogen rich synthetic gas, to run the system 10. For example, the fuel nozzles 20 may intake a fuel supply 22 and an oxidizing medium 24 (see FIG. 2) from the compressor 12, mix the fuel supply 22 with the oxidizing medium 24 to create a coolant-fuel mix, and discharge the coolant-fuel mix into the combustor 14. The oxidizing medium 24 may, in exemplary embodiments, be air. However, it should be understood that the oxidizing medium 24 of the present disclosure is not limited to air, but may be any suitable fluid. The coolant-fuel mix accepted by the combustor 14 may combust within combustor 14, thereby creating a hot pressurized exhaust gas, or hot gas flow 26. The combustor 14 may direct the hot gas flow 26 through a hot gas path 28 within the combustor 14 into the turbine 16. As the hot gas flow 26 passes through the turbine 16, the turbine 16 may cause the shaft 18 to rotate. The shaft 18 may be connected to various components of the turbine system 10, including the compressor 12. Thus, rotation of the shaft 18 may cause the compressor 12 to operate, thereby compressing the oxidizing medium 24.

Thus, in operation, oxidizing medium 24 may enter the turbine system 10 and be pressurized in the compressor 12. The oxidizing medium 24 may then be mixed with fuel supply 22 for combustion within combustor 14. For example, the fuel nozzles 20 may inject a fuel-coolant mixture into the combustor 14 in a suitable ratio for optimal combustion, emissions, fuel consumption, and power output. The combustion may generate hot gas flow 26, which may be provided through the combustor 14 to the turbine 16.

Figure 2:
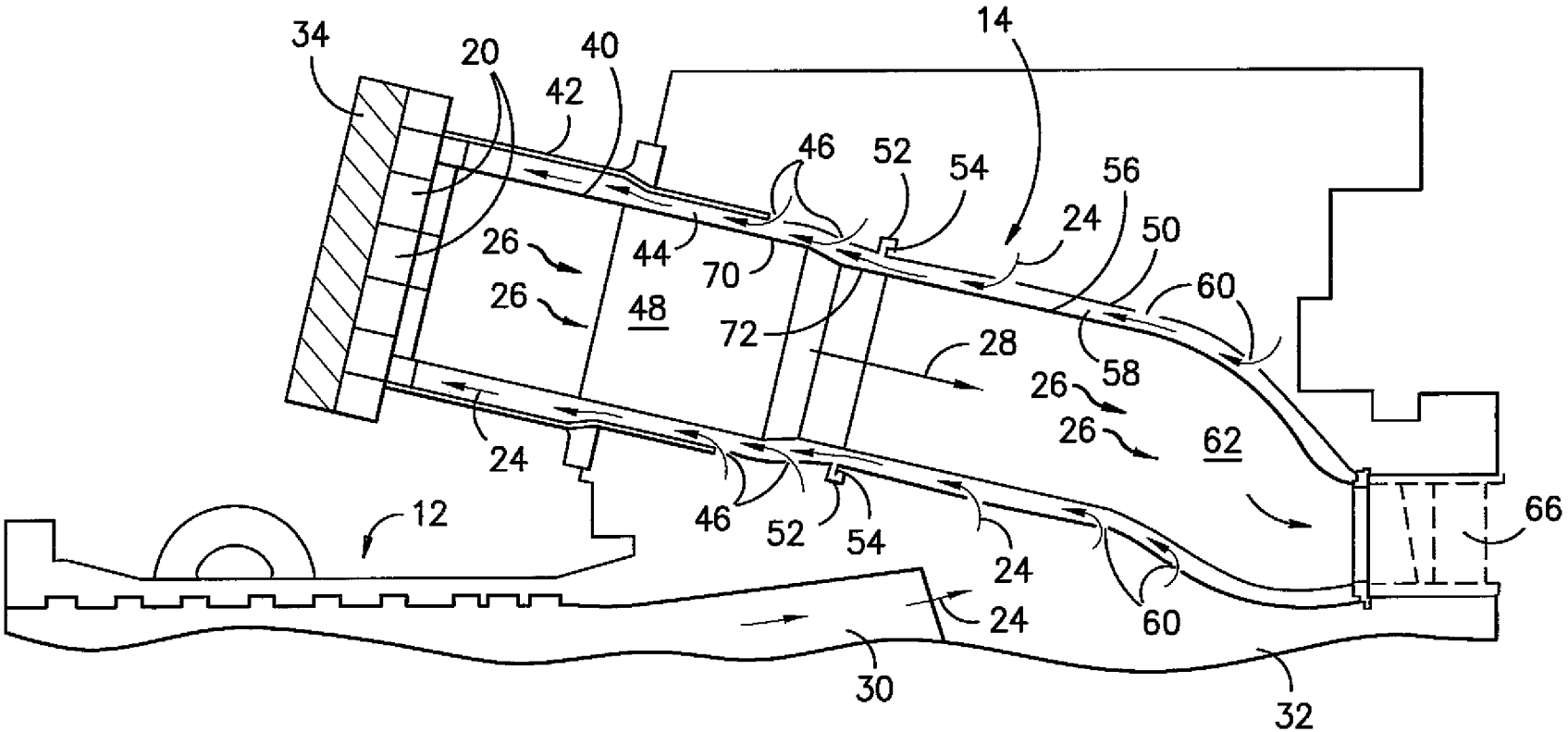
FIG. 2 is a side cutaway view of one embodiment of various components of the gas turbine system of the present disclosure.

As illustrated in FIG. 2, the combustor 14 is generally fluidly coupled to the compressor 12 and the turbine 16. The compressor 12 may include a diffuser 30 and a discharge plenum 32 that are coupled to each other in fluid communication, so as to facilitate the channeling of oxidizing medium 24 to the combustor 14. For example, after being compressed in the compressor 12, oxidizing medium 24 may flow through the diffuser 30 and be provided to the discharge plenum 32. The oxidizing medium 24 may then flow from the discharge plenum 32 through the fuel nozzles 20 to the combustor 14.

The combustor 14 may include a cover plate 34 at the upstream end of the combustor 14. The cover plate 34 may at least partially support the fuel nozzles 20 and provide a path through which oxidizing medium 24 and fuel supply 22 may be directed to the fuel nozzles 20.

The combustor 14 may comprise a hollow annular wall configured to facilitate oxidizing medium 24. For example, the combustor 14 may include a combustor liner 40 disposed within a flow sleeve 42. The arrangement of the combustor liner 40 and the flow sleeve 42, as shown in FIG. 2, is generally concentric and may define an annular passage or flow path 44 therebetween. In certain embodiments, the flow sleeve 42 and the combustor liner 40 may define a first or upstream hollow annular wall of the combustor 14. The flow sleeve 42 may include a plurality of inlets 46, which provide a flow path for at least a portion of the oxidizing medium 24 from the compressor 12 through the discharge plenum 32 into the flow path 44. In other words, the flow sleeve 42 may be perforated with a pattern of openings to define a perforated annular wall. The interior of the combustor liner 40 may define a substantially cylindrical or annular combustion chamber 48 and at least partially define the hot gas path 28 through which hot gas flow 26 may be directed.

Downstream from the combustor liner 40 and the flow sleeve 42, an impingement sleeve 50 may be coupled to the flow sleeve 42. The flow sleeve 42 may include a mounting flange 52 configured to receive a mounting member 54 of the impingement sleeve 50. A transition piece 56 may be disposed within the impingement sleeve 50, such that the impingement sleeve 50 surrounds the transition piece 56. A concentric arrangement of the impingement sleeve 50 and the transition piece 56 may define an annular passage or flow path 58 therebetween. The impingement sleeve 50 may include a plurality of inlets 60, which may provide a flow path for at least a portion of the oxidizing medium 24 from the compressor 12 through the discharge plenum 32 into the flow path 58. In other words, the impingement sleeve 50 may be perforated with a pattern of openings to define a perforated annular wall. An interior cavity 62 of the transition piece 56 may further define hot gas path 28 through which hot gas flow 26 from the combustion chamber 48 may be directed into the turbine 16.

As shown, the flow path 58 is fluidly coupled to the flow path 44. Thus, together, the flow paths 44 and 58 define a flow path configured to provide oxidizing medium 24 from the compressor 12 and the discharge plenum 32 to the fuel nozzles 20, while also cooling the combustor 14.

As discussed above, the turbine system 10, in operation, may intake oxidizing medium 24 and provide the oxidizing medium 24 to the compressor 12. The compressor 12, which is driven by the shaft 18, may rotate and compress the oxidizing medium 24. The compressed oxidizing medium 24 may then be discharged into the diffuser 30. The majority of the compressed oxidizing medium 24 may then be discharged from the compressor 12, by way of the diffuser 30, through the discharge plenum 32 and into the combustor 14. Additionally, a small portion (not shown) of the compressed oxidizing medium 24 may be channeled downstream for cooling of other components of the turbine engine 10.

A portion of the compressed oxidizing medium 24 within the discharge plenum 32 may enter the flow path 58 by way of the inlets 60. As discussed below, a portion of the oxidizing medium 24, illustrated as cooling medium 64, may be directed from the flow path 58 to the combustor liner 40, and may serve to cool the combustor liner 40. The remaining oxidizing medium 24 in the flow path 58 may then be channeled upstream through flow path 44, such that the oxidizing medium 24 is directed over the combustor liner 40. Thus, a flow path is defined in the upstream direction by flow path 58 (formed by impingement sleeve 50 and transition piece 56) and flow path 44 (formed by flow sleeve 42 and combustor liner 40). Accordingly, flow path 44 may receive oxidizing medium 24 from both flow path 58 and inlets 46. The oxidizing medium 24 through the flow path 44 may then be channeled upstream towards the fuel nozzles 20, wherein the oxidizing medium 24 may be mixed with fuel supply 22 and ignited within the combustion chamber 48 to create hot gas flow 26. The hot gas flow 26 may be channeled through the combustion chamber 48 along the hot gas path 28 into the transition piece cavity 62 and through a turbine nozzle 66 to the turbine 16.

FIGS. 3 through 7 illustrate perspective views of various embodiments of portions of the combustor liner 40 of the present disclosure. The combustor liner 40 may, in general, include an upstream portion 70 and a downstream end portion 72 extending from the upstream portion 70 along a generally longitudinal axis 73. The downstream end portion 72 may be that portion of the combustor liner 40 that is associated with the transition piece 56. Further, the downstream end portion 72 may include an inner surface 74 and an outer surface 76. The inner surface 74 may be that surface generally associated with hot gas path 28, while the outer surface 76 may be that surface generally associated with the transition piece 56. It should be understood that the upstream portion 70 and downstream end portion 72 may have any suitable configurations, such as any suitable lengths, radii, and tapered or non-tapered portions.

The combustor liner 40 of the present disclosure may further include a cover layer 78. The cover layer 78 may be associated with the inner surface 74 of the downstream end portion 72, as discussed below.

The inner surface 74 of the downstream end portion 72 may define a plurality of microchannels 80. The microchannels 80 may be configured to flow cooling medium 64 therethrough, cooling the downstream end portion 72 and the combustor liner 40 in general. For example, the microchannels 80 may generally be open channels formed and defined on the inner surface 74. Additionally, the cover layer 78 associated with the inner surface 74 may cover, and in exemplary embodiments may further define, the microchannels 80. Cooling medium 64 flowed to the microchannels 80, as discussed below, may flow through the microchannels 80 between the inner surface 74 and the cover layer 78, cooling the downstream end portion 72 and the cover layer 78, and may then be exhausted from the microchannels 80, as discussed below. The microchannels 80 may be formed in the downstream end portion 72 through, for example, laser machining, water-jet machining, electro-chemical machining ("ECM"), electro-discharge machining ("EDM"), photolithography, or any other process capable of providing suitable microchannels 80 with proper sizes and tolerances.

The microchannels 80 may have depths 82 in the range from approximately 0.2 millimeters ("mm") to approximately 3 mm, such as from approximately 0.5 mm to approximately 1 mm. Further, the microchannels 80 may have widths 84 in the range from approximately 0.2 mm to approximately 3 mm, such as from approximately 0.5 mm to approximately 1 mm. Further, the microchannels 80 may have lengths 86. The lengths 86 of the microchannels 80 may be approximately equal to the length of the downstream end portion 72, or may be smaller than or greater than the length of the downstream end portion 72. It should further be understood that the depths 82, widths 84, and lengths 86 of the microchannels 80 need not be identical for each microchannel 80, but may vary between microchannels 80.

In an exemplary embodiment, the depth 82 of each of the plurality of microchannels 80 may be substantially constant throughout the length 86 of the microchannel 80. In another exemplary embodiment, however, the depth 82 of each of the plurality of microchannels 80 may be tapered. For example, the depth 82 of each of the plurality of microchannels 80 may be reduced through the length 86 of the microchannel 80 in the direction of flow of the cooling medium 64 through the microchannel 80. Alternatively, however, the depth 82 of each of the plurality of microchannels 80 may be enlarged through the length 86 of the microchannel 80 in the direction of flow of the cooling medium 64 through the microchannel 80. It should be understood that the depth 82 of each of the plurality of microchannels 80 may vary in any manner throughout the length 86 of the microchannel 80, being reduced and enlarged as desired. Further, it should be understood that various microchannels 80 may have substantially constant depths 82, while other microchannels 80 may have tapered depths 82.

In an exemplary embodiment, the width 84 of each of the plurality of microchannels 80 may be substantially constant throughout the length 86 of the microchannel 80. In another exemplary embodiment, however, the width 84 of each of the plurality of microchannels 80 may be tapered. For example, the width 84 of each of the plurality of microchannels 80 may be reduced through the length 86 of the microchannel 80 in the direction of flow of the cooling medium 64 through the microchannel 80. Alternatively, the width 84 of each of the plurality of microchannels 80 may be enlarged through the length 86 of the microchannel 80 in the direction of flow of the cooling medium 64 through the microchannel 80. It should be understood that the width 84 of each of the plurality of microchannels 80 may vary in any manner throughout the length 86 of the microchannel 80, being reduced and enlarged as desired. Further, it should be understood that various microchannels 80 may have substantially constant widths 84, while other microchannels 80 may have tapered widths 84.

The microchannels 80 may have cross-sections with any geometric shape, such as, for example, rectangular, oval, triangular, or having any other geometric shape suitable to facilitate the flow of cooling medium 64 through the microchannel 80. It should be understood that various microchannels 80 may have cross-sections with certain geometric shapes, while other microchannels 80 may have cross-sections with other various geometric shapes.

In some embodiments, the microchannels 80 may extend linearly through the downstream end portion 72 with respect to the longitudinal axis 73. Alternatively, the microchannels 80 may extend helically about the downstream end portion 72 with respect to the longitudinal axis 73. In further alternative embodiments, the microchannels 80 may be may be generally curved, sinusoidal, or serpentine microchannels 80.

In exemplary embodiments, each of the plurality of microchannels 80 may have a substantially smooth surface. For example, the surface of the microchannels 80 may be substantially or entirely free of protrusions, recesses, or surface texture. In an alternative embodiment, however, each of the plurality of microchannels 80 may have a surface that includes a plurality of surface features. The surface features may be discrete protrusions extending from the surface of the microchannels 80. For example, the surface features may include fin-shaped protrusions, cylindrical-shaped protrusions, ring-shaped protrusions, chevron-shaped protrusions, raised portions between cross-hatched grooves formed within the microchannel 80, or any combination thereof, as well as any other suitable geometric shape. It should be understood that the dimensions of the surface features may be selected to optimize cooling of the downstream end portion 72 and the combustor liner 40 in general while satisfying the geometric constraints of the microchannels 80.

In some embodiments, each of the microchannels 80 may be singular, discrete microchannels 80. In other embodiments, however, each of the microchannels 80, or any portion of the microchannels 80, may branch off from single microchannels 80 to form multiple microchannel branches.

The downstream end portion 72 may further define a plurality of passages 90. The passages 90 may extend between the inner surface 74 and outer surface 76 of the downstream end portion 72. The plurality of microchannels 80 may be fluidly connected to the plurality of passages 90. For example, the passages 90 may be defined in the downstream end portion 72 in generally annular arrays, as shown in FIGS. 3, 4 and 5, and/or in relatively linear patterns, as shown in FIGS. 4 and 5, or in any other suitable patterns or arrays. Thus, cooling medium 64 provided to the combustor liner 40 may be flowed through the passages 90 and provided to the microchannels 80.

Further, each of the plurality of passages 90 may be configured to provide impingement cooling to the cover layer 78. For example, the passages 90 may be oriented generally perpendicularly within the downstream end portion 72 with respect to the cover layer 78. Thus, as cooling medium 64 flows through the passages 90 and is provided to the microchannels 80, the cooling medium 64 may be exhausted from the passages 90 and may impinge on the cover layer 78, providing impingement cooling of the cover layer 78.

After the cooling medium 64 flows through the microchannels 80, cooling the downstream end portion 72 and the combustor liner 40, as well as cooling the cover layer 78, the cooling medium 64 may be exhausted from the microchannels 80. For example, in one embodiment as shown in FIGS. 3, 4 and 5, the cooling medium 64 may be exhausted directly from the microchannels 80. The cooling medium 64 may thus flow directly from the microchannels 80 into the hot gas path 28.

Alternatively, as shown in FIGS. 6 and 7, the cooling medium 64 may be exhausted adjacent the cover layer 78 into the hot gas path 28. For example, the cover layer 78 may define a plurality of exhaust passages 92. Further, the inner surface 74 of the downstream end portion 72 may define a plenum 94 or a plurality of plenums 94. As shown in FIG. 7, the plenum 94 or plenums 94 may be configured to accept cooling medium from the plurality of microchannels 80, or from at least a portion of the plurality of microchannels 80. In general, for example, the plenum 94 or plenums 94 may be defined annularly about the downstream end of the downstream end portion 72 with respect to the hot gas flow 26, and may be in fluid communication with the plurality of microchannels 80. Thus, cooling medium 64 flowing through the microchannels 80 may exit the microchannels 80 into the plenum 94, and may, in exemplary embodiments, be distributed throughout the plenum before being exhausted from the downstream end portion 72.

Each of the exhaust passages 92 may be fluidly connected to one of the plurality of microchannels 80, as shown in FIG. 6, or to a plenum 94, as shown in FIG. 7. Further, each of the exhaust passages 92 may be configured to accept cooling medium 64 from the plurality of microchannels 80 or from the plenum 94 and exhaust the cooling medium 64 adjacent the cover layer 78. For example, the exhaust passages 92 may extend generally between an inner surface 102 and an outer surface 104 (see FIGS. 8 through 10) of the cover layer 78, and may be fluidly connected to the microchannels 80 or the plenum 94. The hot gas flow 26 may flow past the inner surface 102 of the cover layer 78 at a pressure generally lower than the pressure in the passages 90 and microchannels 80. This pressure differential may cause the cooling medium 64 flowing through the microchannels 80 to flow from the microchannels 80 into and through the exhaust passages 92 and exhaust from the exhaust passages 92 adjacent the inner surface 102 of the cover layer 78 and into the hot gas path 28. It should be understood that each microchannel 80 may be connected to one or more of the exhaust passages 92. It should further be understood that the exhaust passages 92 may be oriented at any angle with respect to the microchannels 80 and/or the plenum 94. Additionally, it should be understood that the exhaust passages 92 may have generally circular or oval cross-sections, generally rectangular cross-sections, generally triangular cross-sections, or may have any other suitably shaped polygonal cross-sections.

Figure 8:
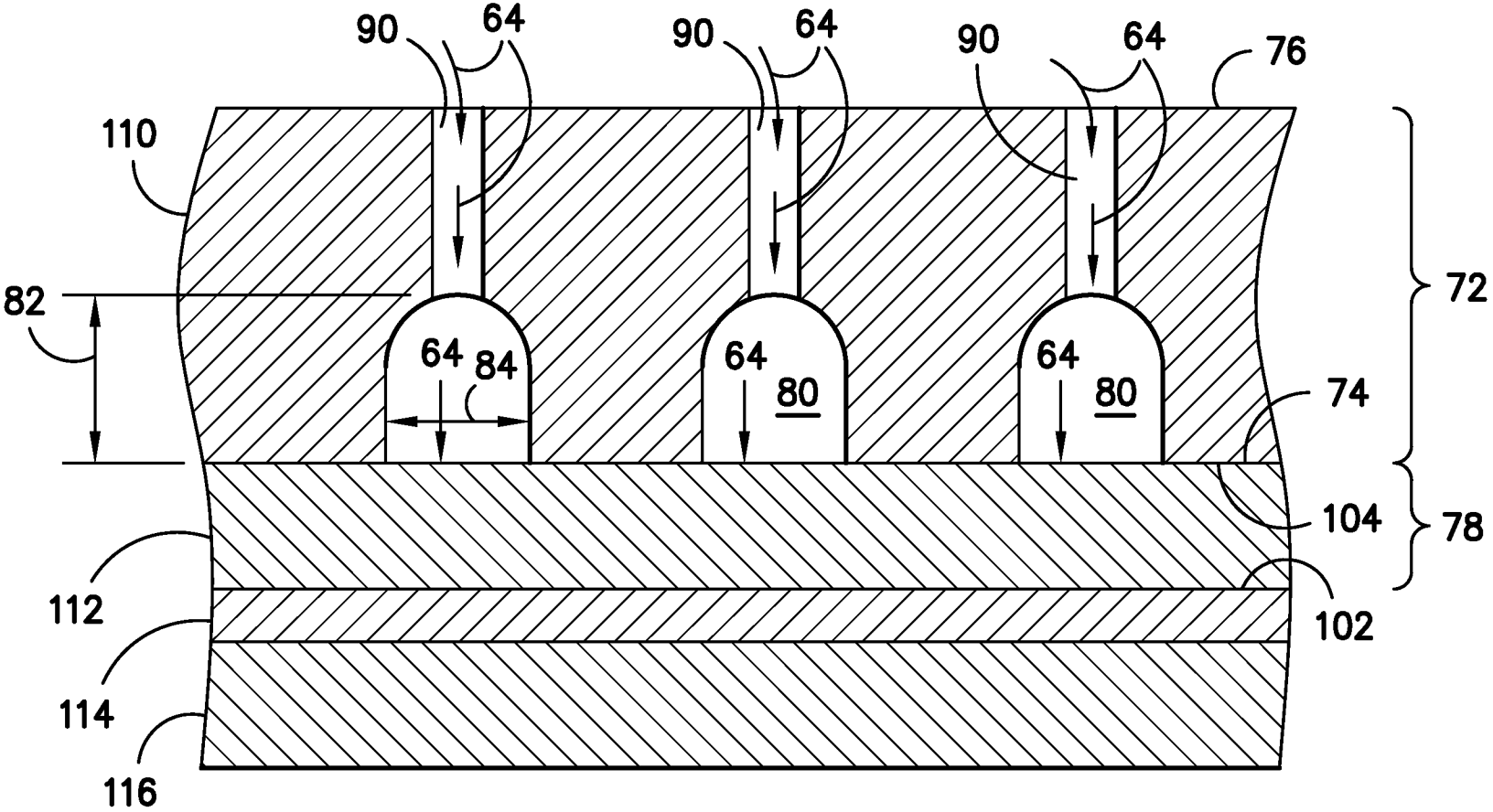
FIG. 8 is a cross-sectional view of one embodiment of the downstream end portion of the combustor liner of the present disclosure.

The downstream end portion 72 and the cover layer 78 may each comprise a singular material, such as a substrate or a coating, or may each comprise a plurality of materials, such as a plurality of substrates and coatings. For example, in one exemplary embodiment as shown in FIG. 8, the downstream end portion 72 may comprise a combustor liner substrate 110. For example, the substrate 110 may be a nickel-, cobalt-, or iron-based superalloy. The alloys may be cast or wrought superalloys. It should be understood that the combustor liner substrate 110 of the present disclosure is not limited to the above materials, but may be any suitable material for any portion of a combustor liner 40.

Further, as shown in FIG. 8, the cover layer 78 may comprise a metal coating 112. In one exemplary aspect of an embodiment, the metal coating 112 may be any metal or metal alloy based coating, such as, for example, a nickel-, cobalt-, iron-, zinc-, or copper-based coating.

Alternatively, the cover layer 78 may comprise a bond coating 114. The bond coating 114 may be any appropriate bonding material. For example, the bond coating 114 may have the chemical composition MCrAl(X), where M is an element selected from the group consisting of Fe, Co and Ni and combinations thereof, and (X) is an element selected from the group consisting of gamma prime formers, solid solution strengtheners, consisting of, for example, Ta, Re and reactive elements, such as Y, Zr, Hf, Si, and grain boundary strengtheners consisting of B, C and combinations thereof. The bond coating 114 may be applied to the downstream end portion 72 through, for example, a physical vapor deposition process such as electron beam evaporation, ion-plasma arc evaporation, or sputtering, or a thermal spray process such as air plasma spray, high velocity oxy-fuel or low pressure plasma spray. Alternatively, the bond coating 114 may be a diffusion aluminide bond coating, such as a coating having the chemical composition NiAl or PtAl, and the bond coating 114 may be applied to the downstream end portion 72 through, for example, vapor phase aluminiding or chemical vapor deposition.

Alternatively, the cover layer 78 may comprise a thermal barrier coating ("TBC") 116. The TBC 116 may be any appropriate thermal barrier material. For example, the TBC 116 may be yttria-stabilized zirconia, and may be applied to the downstream end portion 72 through a physical vapor deposition process or thermal spray process. Alternatively, the TBC 116 may be a ceramic, such as, for example, a thin layer of zirconia modified by other refractory oxides such as oxides formed from Group IV, V and VI elements or oxides modified by Lanthanide series elements such as La, Nd, Gd, Yb and the like.

In other exemplary embodiments, as discussed above, the downstream end portion 72 and the cover layer 78 may each comprise a plurality of materials, such as a plurality of substrates and coatings. For example, in one embodiment as shown in FIG. 9, the downstream end portion 72 may comprise a combustor liner substrate 110 and a bond coating 114. The downstream end portion 72 may include the outer surface 76, and the bond coating 114 may include the inner surface 74. Thus, the plurality of microchannels 80 may be defined in the bond coating 114. Further, as shown in FIG. 9, the cover layer 78 may comprise a TBC 116.

In another embodiment as shown in FIG. 10, the downstream end portion 72 may comprise a combustor liner substrate 110, a bond coating 114, and a first TBC 116. The combustor liner substrate 110 may include the outer surface 76, and the first TBC 116 may include the inner surface 74. Thus, the plurality of microchannels 80 may be defined in the first TBC 116. Further, as shown in FIG. 10, the cover layer 78 may comprise a second TBC 118.

Additionally, as shown in FIG. 8, the combustor liner 40 may include a TBC 116 disposed adjacent the cover layer 78. Further, as shown in FIG. 8, the combustor liner 40 may include a bond coating 114 disposed between the TBC 116 and the cover layer 78. Alternatively, the cover layer 78 may include the metal coating 112, the bond coating 114, and the TBC 116.

In some embodiments, as shown in FIG. 4, the outer surface 76 of the downstream end portion 72 may define a plurality of channels 120. The channels 120 may be configured to flow cooling medium 64 therethrough, further cooling the downstream end portion 72 and the combustor liner 40 in general. The channels 120 may be microchannels, having any of the characteristics of the microchannels 80, or may be larger than the microchannels 80 and, for example, formed using any suitable technique, such as milling, casting, molding, or laser etching/cutting.

The channels 120 may be fluidly connected to the microchannels 80. For example, at least a portion of the passages 90 may be fluidly connected to at least a portion of the channels 120. As shown in FIG. 4, various of the passages 90 may be defined in channels 120. Thus, cooling medium 64 flowing through the channels 120 may be accepted by the passages 90, and may flow through the passages 90 to the microchannels 80.

The combustor 14 of the present disclosure may further include a sealing ring 130, as shown in FIGS. 3 through 5. The sealing ring 130 may provide a seal between the combustor liner 40, such as the downstream end portion 72, and the transition piece 56.

In exemplary embodiments, as shown in FIG. 5, the sealing ring 130 may further define a plurality of feed passages 132. The feed passages 132 may be configured to flow cooling medium 64 therethrough. For example, cooling medium 64 flowing to the downstream end portion 72 may flow at least partially over the sealing ring 130, and at least a portion of this cooling medium 64 may be accepted by the feed passages 132.

Further, at least a portion of the passages 90 defined in the downstream end portion 72 may be configured to accept cooling medium 64 from the plurality of feed passages 132. For example, various of the passages 90 may be defined in the downstream end portion 72 such that, when the sealing ring 130 is positioned adjacent the downstream end portion 72, these passages 90 are generally covered by the sealing ring 130. Thus, cooling medium 64 flowing through the sealing ring 130 via the feed passages 132 may be accepted by these passages 90 and generally flowed to the microchannels 80. It should be understood, however, that other passages 90 may be defined in the downstream end portion 72 outside of the sealing ring 130, and these passages 90 may accept cooling medium 64 other than the cooling medium 64 that is flowed through the feed passages 132.

In other exemplary embodiments, as shown in FIG. 4, the combustor may further comprise an annular wrapper 140. The annular wrapper 140 may be disposed between the combustor liner 40, such as the downstream end portion 72, and the sealing ring 130. The annular wrapper 140 may define a plurality of feed passage 142. The feed passages 142 may be configured to flow cooling medium 64 therethrough. For example, cooling medium 64 flowing to the downstream end portion 72 may flow at least partially over the annular wrapper 140, and at least a portion of this cooling medium 64 may be accepted by the feed passages 142. In some embodiments, a seal plate 144 may be disposed on or adjacent the downstream end of the annular wrapper 140. The seal plate 144 may prevent cooling medium 64 from flowing past the annular wrapper 140, and may encourage the flow of cooling medium 64 to the feed passages 142.

Further, at least a portion of the passages 90 defined in the downstream end portion 72 may be configured to accept cooling medium 64 from the plurality of feed passages 142. For example, various of the passages 90 may be defined in the downstream end portion 72 such that, when the annular wrapper 140 is positioned adjacent the downstream end portion 72, these passages 90 are generally covered by the annular wrapper 140. Thus, cooling medium 64 flowing through the annular wrapper 140 via the feed passages 142 may then be accepted by these passages 90, and generally flowed to the microchannels 80. It should be understood, however, that other passages 90 may be defined in the downstream end portion 72 outside of the annular wrapper 140, and these passages 90 may accept cooling medium 64 other than the cooling medium 64 that is flowed through the feed passages 142.

By utilizing microchannels 80 and passages 90 as described herein, cooling of the combustor liner 40 is provided at a relatively high heat transfer rate and with a relatively uniform temperature profile. Thus, the life of the combustor liner 40 may be extended, and the combustor liner 40 may further allow the utilization of higher temperature hot gas flows 26, thus increasing the performance and efficiency of the system 10. Further, the amount of cooling medium 64 required for cooling may be reduced through the use of microchannels 80 and passages 90, thus reducing the amount of oxidizing medium 24 being diverted for cooling. Beneficially, this reduction may lower NOx emissions and reduce cool streaks adjacent the combustor liner 40 and transition piece 56, further reducing CO levels on turndown.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor liner comprising:

an upstream portion;

a downstream end portion extending from the upstream portion along a generally longitudinal axis, the downstream end portion including an inner surface and an outer surface, the inner surface defining a plurality of microchannels, each of the plurality of microchannels extending longitudinally along the inner surface, the downstream end portion further defining a plurality of passages extending between the inner surface and the outer surface, wherein the plurality of microchannels are fluidly connected to the plurality of passages such that each of the plurality of passages is directly connected to one of the plurality of microchannels; and a cover layer associated with the inner surface of the downstream end portion, wherein the plurality of microchannels are configured to flow a cooling medium therethrough, cooling the combustor liner.

2. The combustor liner of claim 1, wherein the cover layer is one of a metal coating, a bond coating, or a thermal barrier coating.

3. The combustor liner of claim 1, further comprising a thermal barrier coating disposed adjacent the cover layer.

4. The combustor liner of claim 3, further comprising a bond coating disposed between the thermal barrier coating and the cover layer.

5. The combustor liner of claim 1, wherein the downstream end portion comprises a combustor liner substrate.

6. The combustor liner of claim 1, wherein the downstream end portion comprises a combustor liner substrate and a bond coating, and wherein the plurality of microchannels are defined in the bond coating.

7. The combustor liner of claim 6, wherein the cover layer comprises a thermal barrier coating.

8. The combustor liner of claim 1, wherein the downstream end portion comprises a combustor liner substrate, a bond coating, and a first thermal barrier coating, and wherein the plurality of microchannels are defined in the first thermal barrier coating.

9. The combustor liner of claim 8, wherein the cover layer comprises a second thermal barrier coating.

10. The combustor liner of claim 1, wherein the plurality of microchannels extend linearly with respect to the longitudinal axis.

11. The combustor liner of claim 1, wherein the plurality of microchannels extend helically with respect to the longitudinal axis.

12. The combustor liner of claim 1, wherein the outer surface of the downstream end portion defines a plurality of channels, each of the plurality of channels configured to flow cooling medium therethrough, cooling the combustor liner, and wherein at least a portion of the plurality of passages are further fluidly connected to at least a portion of the channels.

13. The combustor liner of claim 1, wherein cooling medium is exhausted directly from the plurality of microchannels.

14. The combustor liner of claim 1, wherein the cover layer defines a plurality of exhaust passages, each of the plurality of exhaust passages fluidly connected to one of the plurality of microchannels and configured to accept cooling medium from the microchannel and exhaust cooling medium adjacent the cover layer.

15. The combustor liner of claim 1, wherein the inner surface of the downstream end portion further defines a plenum, the plenum configured to accept cooling medium from the plurality of microchannels.

16. The combustor liner of claim 15, wherein the cover layer defines a plurality of exhaust passages, each of the plurality of exhaust passages fluidly connected to the plenum and configured to accept cooling medium from the plenum and exhaust cooling medium adjacent the cover layer.

17. A combustor comprising:

a combustor liner at least partially defining a hot gas path, the combustor liner including an upstream portion and a downstream end portion extending from the upstream portion along a generally longitudinal axis, the downstream end portion including an inner surface and an outer surface, the inner surface defining a plurality of microchannels, each of the plurality of microchannels extending longitudinally along the inner surface, the downstream end portion further defining a plurality of passages extending between the inner surface and the outer surface, wherein the plurality of microchannels are fluidly connected to the plurality of passages;

a cover layer associated with the inner surface of the downstream end portion;

a transition piece coupled to the combustor liner and further defining the hot gas path; and a sealing ring providing a seal between the combustor liner and the transition piece, wherein the plurality of microchannels are configured to flow a cooling medium therethrough, cooling the combustor liner.

18. The combustor of claim 17, the sealing ring defining a plurality of feed passages, the feed passages configured to flow cooling medium therethrough, and wherein at least a portion of the passages defined in the downstream end portion are configured to accept cooling medium from the plurality of feed passages.

19. The combustor of claim 17, further comprising an annular wrapper disposed between the combustor liner and the sealing ring, the annular wrapper defining a plurality of feed passages, the plurality of feed passages configured to flow cooling medium therethrough.

20. The combustor of claim 17, wherein the outer surface of the downstream end portion defines a plurality of channels, each of the plurality of channels configured to flow cooling medium therethrough, cooling the combustor liner, and wherein at least a portion of the plurality of passages are further fluidly connected to at least a portion of the channels.

* * * * *